US009144746B2

(12) United States Patent
Cannon

(10) Patent No.: US 9,144,746 B2
(45) Date of Patent: Sep. 29, 2015

(54) TOY WITH LOCATING FEATURE

(75) Inventor: Bruce James Cannon, El Segundo, CA (US)

(73) Assignee: MATTEL, INC., El Segundo, CA (US)

( * ) Notice: Subject to any disclaimer, the term of this patent is extended or adjusted under 35 U.S.C. 154(b) by 854 days.

(21) Appl. No.: 13/213,698

(22) Filed: Aug. 19, 2011

(65) Prior Publication Data

US 2012/0052765 A1 Mar. 1, 2012

Related U.S. Application Data

(60) Provisional application No. 61/375,545, filed on Aug. 20, 2010.

(51) Int. Cl.

| | |
|---|---|
| ***A63H 30/00*** | (2006.01) |
| ***A63H 3/28*** | (2006.01) |
| ***A63H 3/00*** | (2006.01) |

(52) U.S. Cl.

CPC ..... *A63H 3/28* (2013.01); *A63H 3/003* (2013.01); *A63H 3/006* (2013.01)

(58) Field of Classification Search

CPC ..... A63H 3/003; A63H 3/25; A63H 3/28; F41G 3/2666

USPC ..... 446/175, 397, 484

See application file for complete search history.

(56) References Cited

U.S. PATENT DOCUMENTS

| | | | | |
|---|---|---|---|---|
| 4,275,385 | A | | 6/1981 | White |
| 4,840,602 | A | | 6/1989 | Rose |
| 4,934,937 | A | * | 6/1990 | Judd ..... 434/21 |
| 4,938,483 | A | | 7/1990 | Yavetz |
| 4,961,575 | A | * | 10/1990 | Perry ..... 273/460 |
| 4,987,349 | A | | 1/1991 | Nakamura |
| 5,455,851 | A | | 10/1995 | Chaco et al. |
| 5,506,717 | A | | 4/1996 | Kho |
| 5,525,967 | A | | 6/1996 | Azizi et al. |
| 5,572,195 | A | | 11/1996 | Heller et al. |
| 5,578,933 | A | | 11/1996 | Nonaka |
| 5,621,384 | A | | 4/1997 | Crimmins et al. |
| 5,627,524 | A | | 5/1997 | Fredrickson et al. |
| 5,656,907 | A | | 8/1997 | Chainani et al. |
| 5,697,829 | A | | 12/1997 | Chainani et al. |
| 5,724,074 | A | | 3/1998 | Chainani et al. |
| 5,851,012 | A | * | 12/1998 | Langieri et al. ..... 273/317.1 |
| 5,900,817 | A | | 5/1999 | Olmassakian |
| 5,917,425 | A | | 6/1999 | Crimmins et al. |
| 6,066,161 | A | | 5/2000 | Parella |

(Continued)

FOREIGN PATENT DOCUMENTS

| | | | |
|---|---|---|---|
| JP | 200079283 | A | 3/2000 |
| JP | 2007160473 | A | 6/2007 |

(Continued)

*Primary Examiner* — Jay Liddle
*Assistant Examiner* — Alex F. R. P. Rada, II
(74) *Attorney, Agent, or Firm* — Cantor Colburn LLP

(57) ABSTRACT

A toy set is disclosed herein the toy set including: a first object configured to transmit a plurality of codes wirelessly, each of the plurality of codes being transmitted at a different predetermined power level; a second object configured to detect the plurality of codes, the second object providing one of a plurality of audio outputs when at least one of the plurality of codes is detected by the second object; and wherein the one of the plurality of audio outputs is selected by determining which of the plurality of codes detected by the second object has a weakest predetermined power level.

19 Claims, 6 Drawing Sheets

(56) References Cited

U.S. PATENT DOCUMENTS

| | | | | |
|---|---|---|---|---|
| 6,089,942 | A | 7/2000 | Chan | |
| 6,110,000 | A | 8/2000 | Ting | |
| 6,127,931 | A | 10/2000 | Mohr | |
| 6,175,308 | B1 | 1/2001 | Tallman et al. | |
| 6,224,454 | B1 | 5/2001 | Cheng et al. | |
| 6,254,486 | B1 | 7/2001 | Mathieu et al. | |
| 6,309,275 | B1 | 10/2001 | Fong et al. | |
| 6,311,982 | B1 * | 11/2001 | Lebensfeld et al. | 273/460 |
| 6,358,111 | B1 | 3/2002 | Fong et al. | |
| 6,375,535 | B1 | 4/2002 | Fong et al. | |
| 6,380,844 | B2 | 4/2002 | Pelekis | |
| 6,422,911 | B1 | 7/2002 | Grzesek | |
| 6,482,064 | B1 | 11/2002 | Lund | |
| 6,497,604 | B2 | 12/2002 | Fong et al. | |
| 6,497,606 | B2 | 12/2002 | Fong et al. | |
| 6,641,454 | B2 | 11/2003 | Fong et al. | |
| 6,780,077 | B2 | 8/2004 | Baumgartner et al. | |
| 6,788,199 | B2 | 9/2004 | Crabtree et al. | |
| 6,814,667 | B2 * | 11/2004 | Jeffway et al. | 463/51 |
| 7,009,501 | B2 | 3/2006 | Olch | |
| 7,046,153 | B2 | 5/2006 | Oja et al. | |
| 7,066,781 | B2 | 6/2006 | Weston | |
| 7,068,941 | B2 | 6/2006 | Fong et al. | |
| 7,113,089 | B2 | 9/2006 | Ho | |
| 7,148,801 | B2 | 12/2006 | Crabtree et al. | |
| 7,248,170 | B2 | 7/2007 | DeOme et al. | |
| 7,488,231 | B2 | 2/2009 | Weston | |
| 7,598,853 | B2 | 10/2009 | Becker et al. | |
| 8,615,398 | B2 * | 12/2013 | Sampat et al. | 704/501 |
| 2002/0005787 | A1 | 1/2002 | Gabai et al. | |
| 2002/0014742 | A1 * | 2/2002 | Conte et al. | 273/460 |
| 2004/0186623 | A1 * | 9/2004 | Dooley et al. | 700/245 |
| 2005/0096111 | A1 | 5/2005 | Beck | |
| 2006/0009113 | A1 | 1/2006 | Fong et al. | |
| 2006/0109108 | A1 | 5/2006 | Powders | |
| 2006/0183405 | A1 | 8/2006 | Mathews | |
| 2007/0060018 | A1 | 3/2007 | Chou | |
| 2007/0085993 | A1 | 4/2007 | Brown, Jr. | |
| 2007/0128975 | A1 * | 6/2007 | Dimitriou et al. | 446/397 |
| 2007/0173171 | A1 | 7/2007 | Pal Benedek et al. | |
| 2008/0057828 | A1 | 3/2008 | Bowen et al. | |
| 2008/0258886 | A1 | 10/2008 | Summerlin | |
| 2009/0081923 | A1 | 3/2009 | Dooley et al. | |
| 2013/0278398 | A1 * | 10/2013 | Smetanin et al. | 340/12.52 |

FOREIGN PATENT DOCUMENTS

| | | | |
|---|---|---|---|
| WO | 9418100 | | 8/1994 |
| WO | 03037469 | A1 | 5/2003 |
| WO | 2006047584 | A3 | 5/2006 |

* cited by examiner

Replacement Sheet

TOY WITH LOCATING FEATURE

CROSS REFERENCE TO RELATED APPLICATIONS

This application claims the benefit of U.S. Non-provisional patent application Ser. No. 61/375,545 filed Aug. 20, 2011, the contents of which are incorporated herein by reference thereto.

BACKGROUND

Various exemplary embodiments of the present invention are related to a toy having a locating feature and method of using the locating feature.

Toys involving skill and/or luck have been popular for many years. Children, Adults and Adolescents enjoy hind and seek games wherein a person or object is hidden and the winner is the person who has determined the location of the hiding person or object.

Accordingly, it is desirable to provide a toy with a locating feature wherein a hidden object may be found using the locating feature of the toy.

SUMMARY OF THE INVENTION

In one embodiment, a toy set is disclosed herein the toy set including: a first object configured to transmit a plurality of codes wirelessly, each of the plurality of codes being transmitted at a different predetermined power level; a second object configured to detect the plurality of codes, the second object providing one of a plurality of audio outputs when at least one of the plurality of codes is detected by the second object; and wherein the one of the plurality of audio outputs is selected by determining which of the plurality of codes detected by the second object has a weakest predetermined power level.

In another embodiment, the toy set has: a first object configured to transmit a plurality of signals wirelessly in a predetermined repeating sequence, each of the plurality of signals having unique code associated therewith indicating a strength of the signal being transmitted, wherein each of the plurality of signals are transmitted at a different predetermined signal strength such that they are only detectable at predetermined distances from the first object; a second object configured to detect the plurality of signals, the second object providing one of a plurality of audio outputs when at least one of the plurality of signals is detected by the second object; and wherein the one of the plurality of audio outputs is selected by the second object by determining which one of the detected plurality of signals is generated at a weakest predetermined signal strength.

In another embodiment a method for providing audio feedback corresponding to the proximity of a first object and a second object of a toy set is provided, the method including the steps of: transmitting a plurality of codes wirelessly from the first object, each of the plurality of codes being transmitted at a different predetermined power level, wherein each of the codes is indicative of the power level of the code being transmitted; detecting the plurality of codes by the second object; selecting one of a plurality of audio outputs from the second object when one of the plurality of codes is detected by the second object; and wherein the one of the plurality of audio outputs is selected by determining which of the plurality of codes detected by the second object has the weakest predetermined power level.

DETAILED DESCRIPTION

Figure 1:
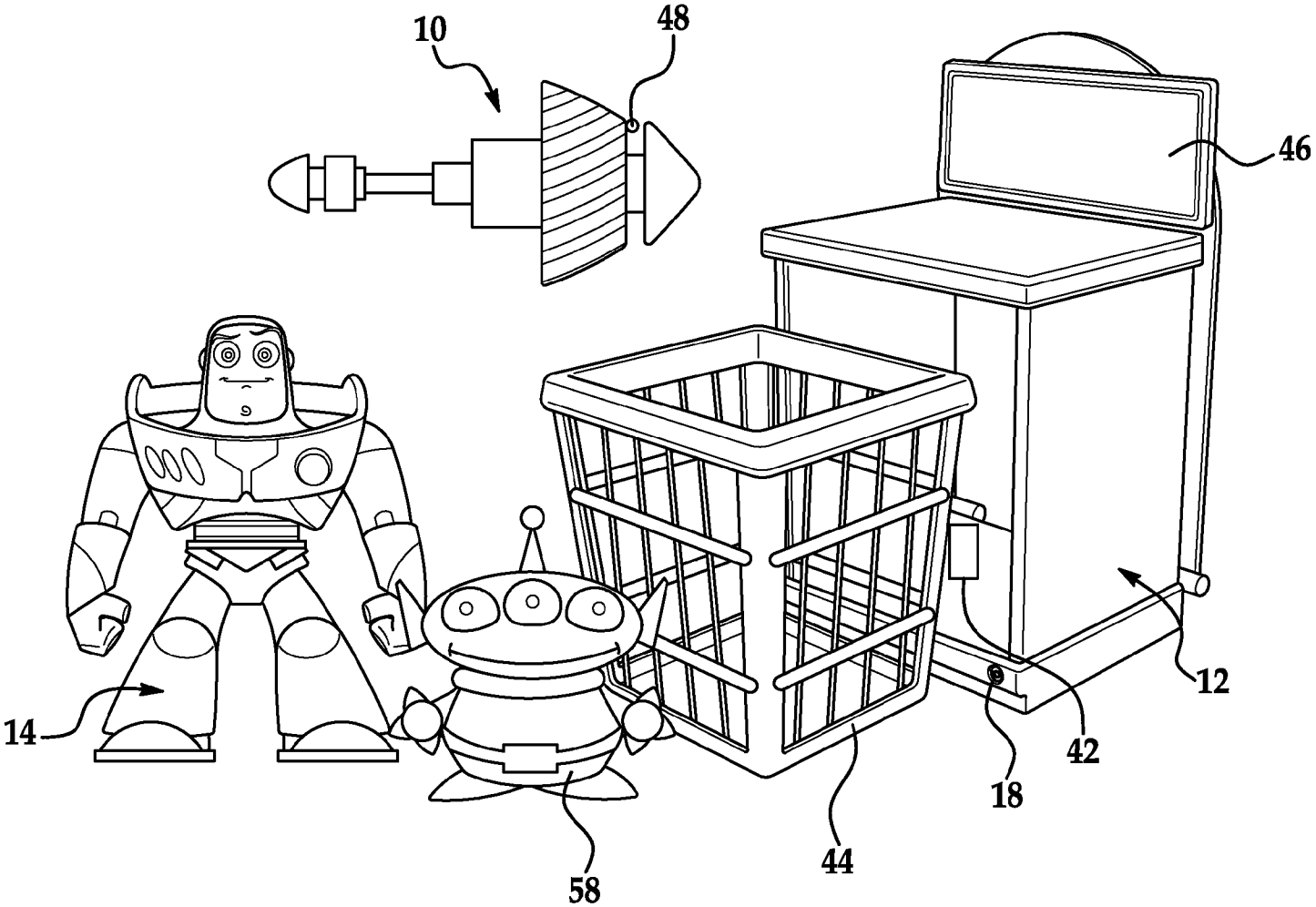
FIG. 1 is a perspective view of the toy set in accordance with an exemplary embodiment of the present invention.

Referring now to the FIGS. and in accordance with exemplary embodiments of the present invention a toy set 10 is illustrated. Toy set 10 has a first object 12 and second object 14. In one embodiment, the first object is configured to transmit or to operate in a "transmit only" mode (e.g., no external signals are received) such that a plurality of signals or codes 16 are transmitted wirelessly. In other words, the first object operates in only a transmit mode. In one embodiment, the first object includes an infrared IR transmitter wherein the signals are transmitted as pulsed IR signals. Of course, other signal types are considered to be within the scope of exemplary embodiments of the present invention. In one embodiment, an infrared emitting diode 18 is used to transmit the plurality of signals from the first object. In one non-limiting embodiment the IR emitting diode is commercially available from Waitrony Optoelectronics Limited.

In another embodiment and in order to expand the range of the transmission of the signals of the first object, two wide angle IR leds 18 are positioned in the first object and each of the IR leds are configured to pulse a modulated code approximately every half second when in operation. Of course, the time frame may vary and is merely provided as an example. Moreover, the number of IR leds is also provided as an example and the number may be greater or less than two.

In one embodiment, the transmitted code may consist of 10 bits, for example a start bit, 8 bits of data, and an end bit. The 8 bits of data may consist of a 4 bit number and a 4 bit checksum. At periodic intervals, for example every ½ second, the first object will pulse a set of two or more unique codes, each at a different power level. Thus, a plurality of ranges or IR fields 20, 22 and 24 are provided and each of the ranges/fields has a unique code associated with it that may be detected at a distance X, Y and Z respectively from the first object 12. For example, one code may be transmitted at low power which corresponds to field 20, a second code is transmitted at a medium power which corresponds to field 22, and a third code that is transmitted at a high power which corresponds to field 24.

The second object has an IR detector or receiver 26 that is configured to detect the plurality of signals when the second object or its receiver is within one of the IR fields being generated by the IR leds. In one non-limiting embodiment the IR detector or receiver is commercially available from Waitrony Optoelectronics Limited. When the IR detector or receiver 26 is within field 20 it will also be able to detect fields 22 and 24. In an exemplary embodiment and in order to differentiate between each of the fields 20, 22 and 24 and their associated signals. A microprocessor or equivalent device of the second object will only use or read the data of the weakest signal received. For example, if the second object and its associated IR detector is located within field 20, field 20 will be the weakest field as compared to fields 22 and 24 so only the data from field 20 will be used in the second object.

The determination of the weakest field detected can in one non-limiting exemplary embodiment be determined by programming in the second object which will be able to differentiate between the unique code of each IR transmission. In other words and in this embodiment, the second object will know that from a plurality of codes for example, code A, code B and code C that code A is the strongest signal or the code generated at the highest power level, code B is the medium signal or the code generated at a medium power level (e.g., less than the power lever of code A) and code C is the weakest signal or the code generated at the lowest power level such that when code A, code B and code C are all detected code C will be used in selecting the appropriate audible and/or visual response and in this example the response corresponding to code C will be outputted by the second object.

In one embodiment the first object controls the output power of the transmitted signal to three discrete levels (of course more or less than three are contemplated) and each level has a corresponding distinct transmitted code. Still further, the code sets are transmitted at periodic intervals. For example and at each interval, code A is transmitted at power level 1, followed by code B at power level 2, followed by code C at power level 3. Depending on distance from the transmitter, the receiver of the second object will hear either: I. Only code C; II. Code C and code B; III. Codes C, B and A. In the first case, it is in the far range, in the second it is in the medium range, and in the third case it is very close to the transmitter.

In addition and in one embodiment, the second object knows or is programmed to know that all three codes or signals are always sent sequentially in a predetermined order and then repeated again, and therefore if the second object only hears or detects two of the codes (e.g., strongest and middle strength and then again only detects the strongest and middle strength code without detecting the weakest strength code) then it is too far away to hear or detect the third or weakest code and therefore it is able to determine its location (middle zone) with respect to the first object. Therefore, the second object can then select an appropriate audio output corresponding to the weakest code detected.

Accordingly, each of the plurality of signals or codes is transmitted at a predetermined signal strength or power lever and the second object is configured to provide an output corresponding to the signal or code of the weakest strength being detected. In one embodiment, the output may be one of a plurality of audio outputs that is selected by determining a weakest of the plurality of signals detected by the second object. In one embodiment, the plurality of audio outputs are prerecorded messages. In another embodiment the plurality of audio outputs are a series of beeps that are played at faster frequencies when the second object is closer to the first object. Still further, they prerecorded messages and beeps may be played together. For example, when the second object is in field 24 a message A is played and X beeps are played in time y. Then when the second object is in field 22 a message B is played and X+n beeps are played in time y. Still further and when the second object is in field 20, a message C is played and X+n+n beeps are played in time y. Accordingly, messages A, B and C correspond to the second object moving closer to the first object and the associated beep frequencies will be played.

In still another exemplary embodiment, the second object will have an LED that blinks with a visible light when the second object is in fields 20, 22 and 24 and similar to the beeps the flashing of the LED will be faster as the second object moves closer to the first object. It is understood that exemplary embodiments contemplate the beeps, prerecorded messages and flashing rates of the LED to be used alone and/or in combination with each other to indicate the proximity of the second object with respect to the first object which, of course, the corresponds to the signals generated by the first object and detected by the second object. Accordingly, the toy comprises at least two pieces or objects: an IR transmitting object; and an item locator comprising an IR detector.

Alternatively, the second object may be configured to actually measure the signal strength of each of the signals received and based upon this information determined the weakest signal detected by the second object.

Figure 4:
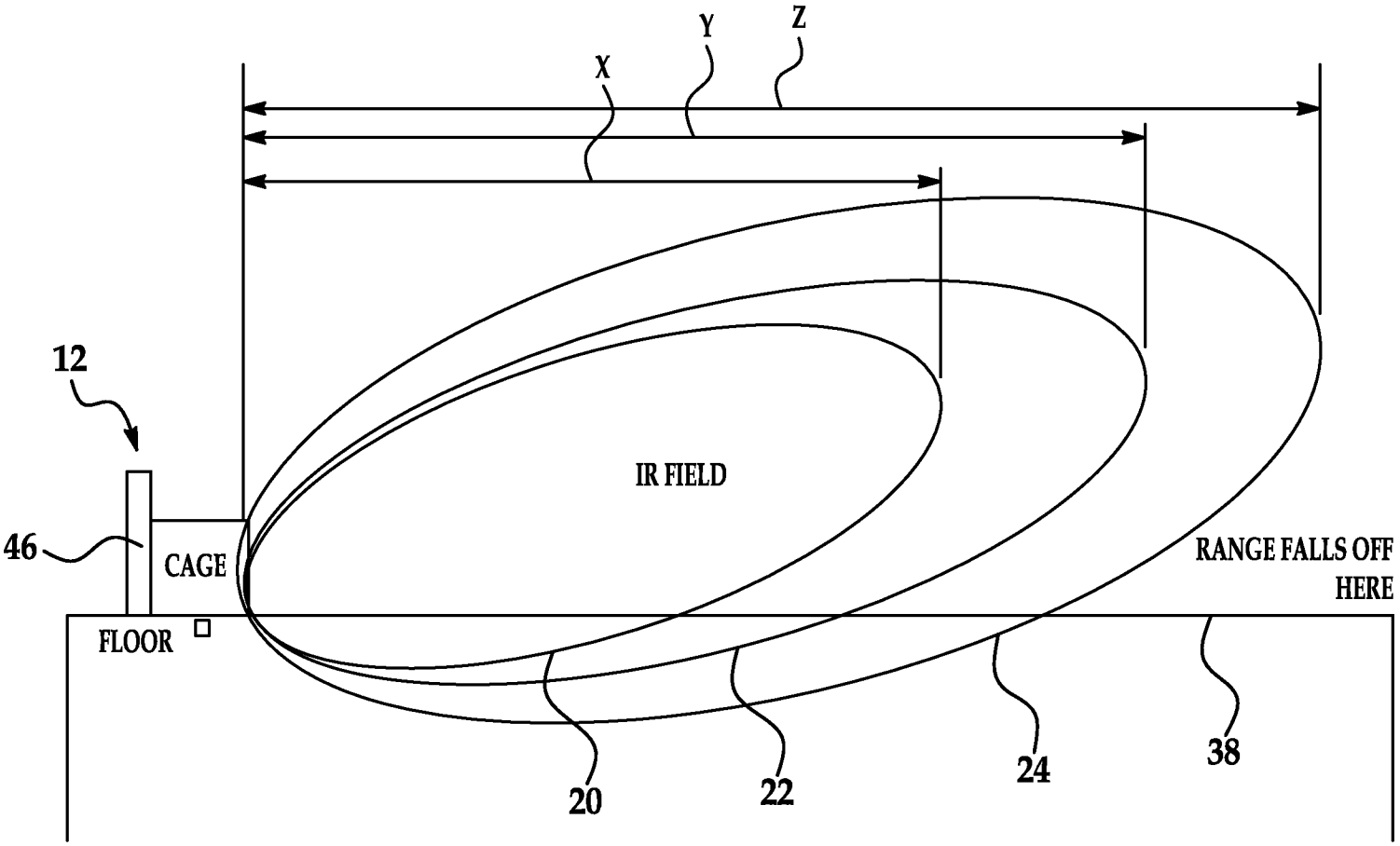
FIGS. 4 and 5 are schematic illustrations of the toy set in accordance with an exemplary embodiment of the present invention.
Figure 5:
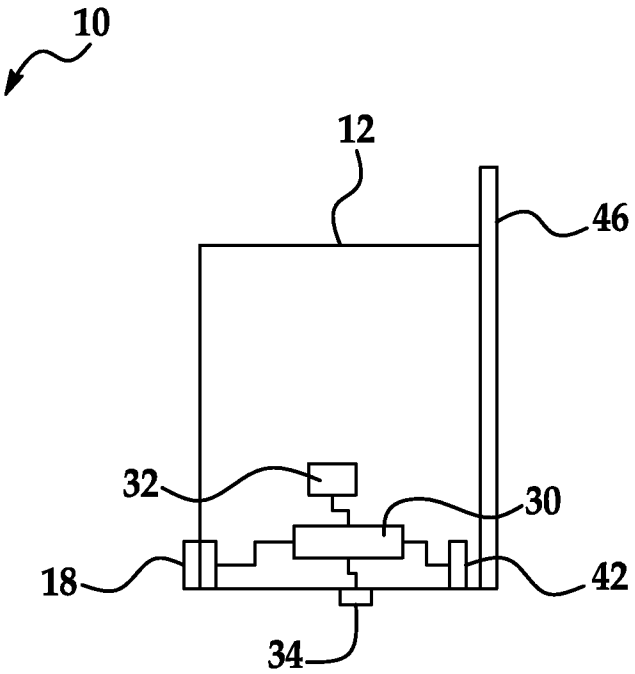
Figure 5:
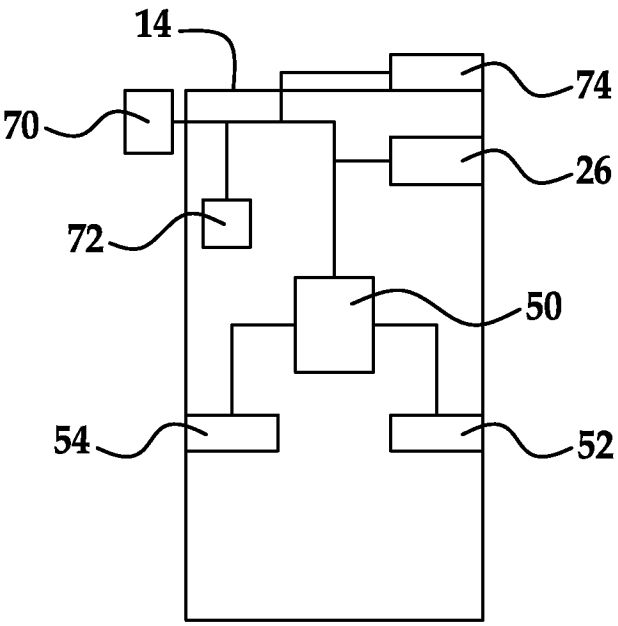

FIG. 5 schematically illustrates one exemplary embodiment of the present invention. Here the first object has a microprocessor or other equivalent device 30 that provides the plurality of signals or codes to the led(s) 18. The processor 30 is coupled to a power supply 32 and a switch 34 is located on a bottom surface 36 of the first object such that once the object is placed upon a surface 38 (FIG. 4) the processor will provide the signals to the IR transmitting LED. In addition, the first object may optionally include an led 33 that blinks with visible light to indicate that the first object is transmitting after switch 34 is depressed.

Figure 2:
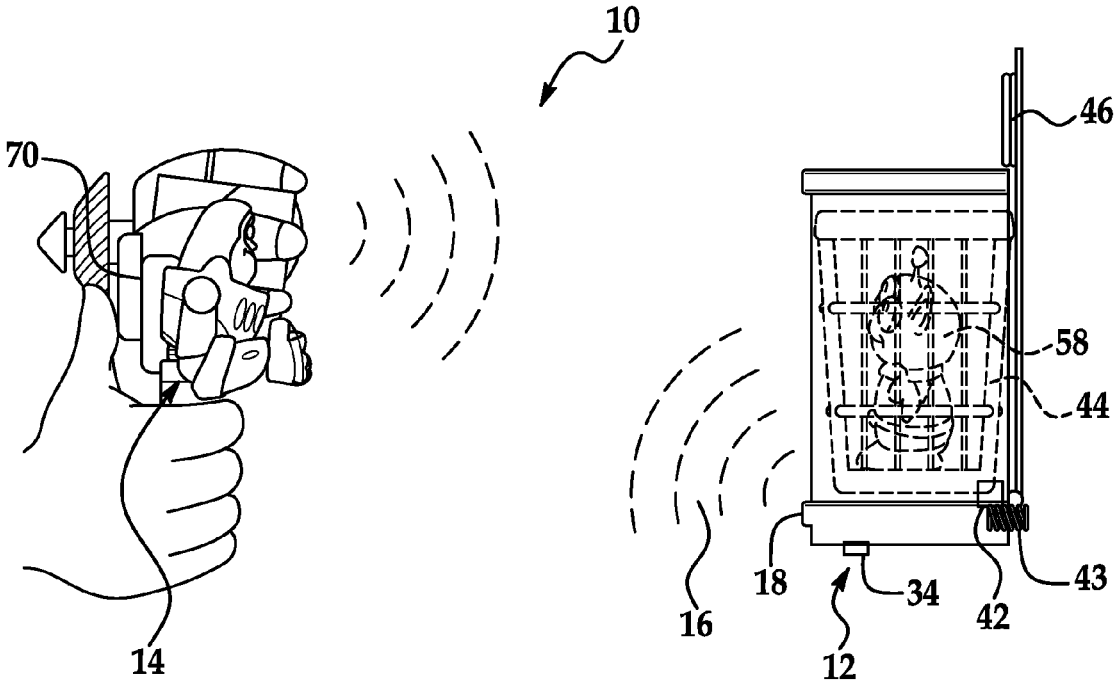
FIG. 2 is a side view of the toy set in accordance with an exemplary embodiment of the present invention.
Figure 2A:
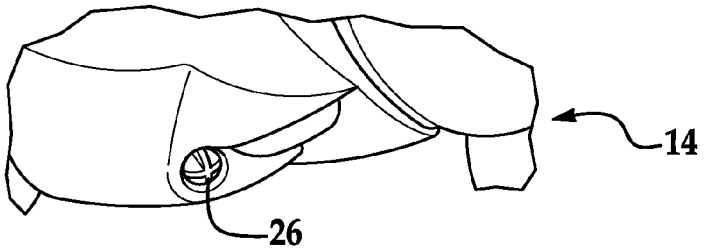
FIGS. 2A and 2B are enlarged views of portions of the toy set.
Figure 2B:
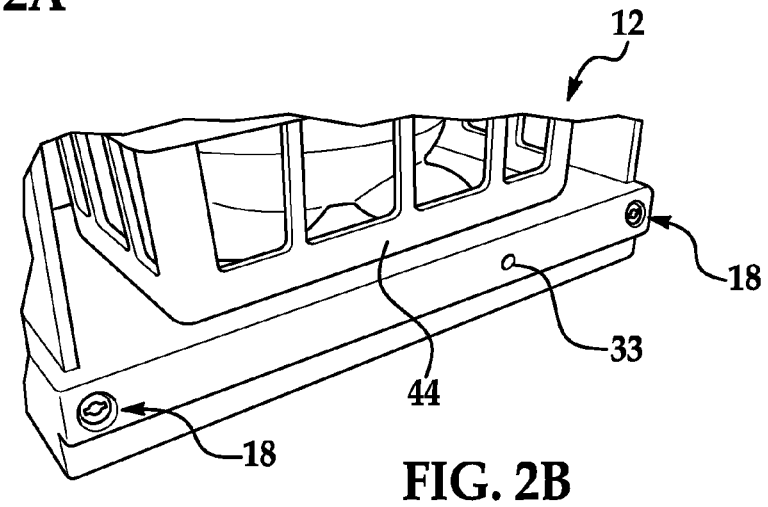
Figure 3:
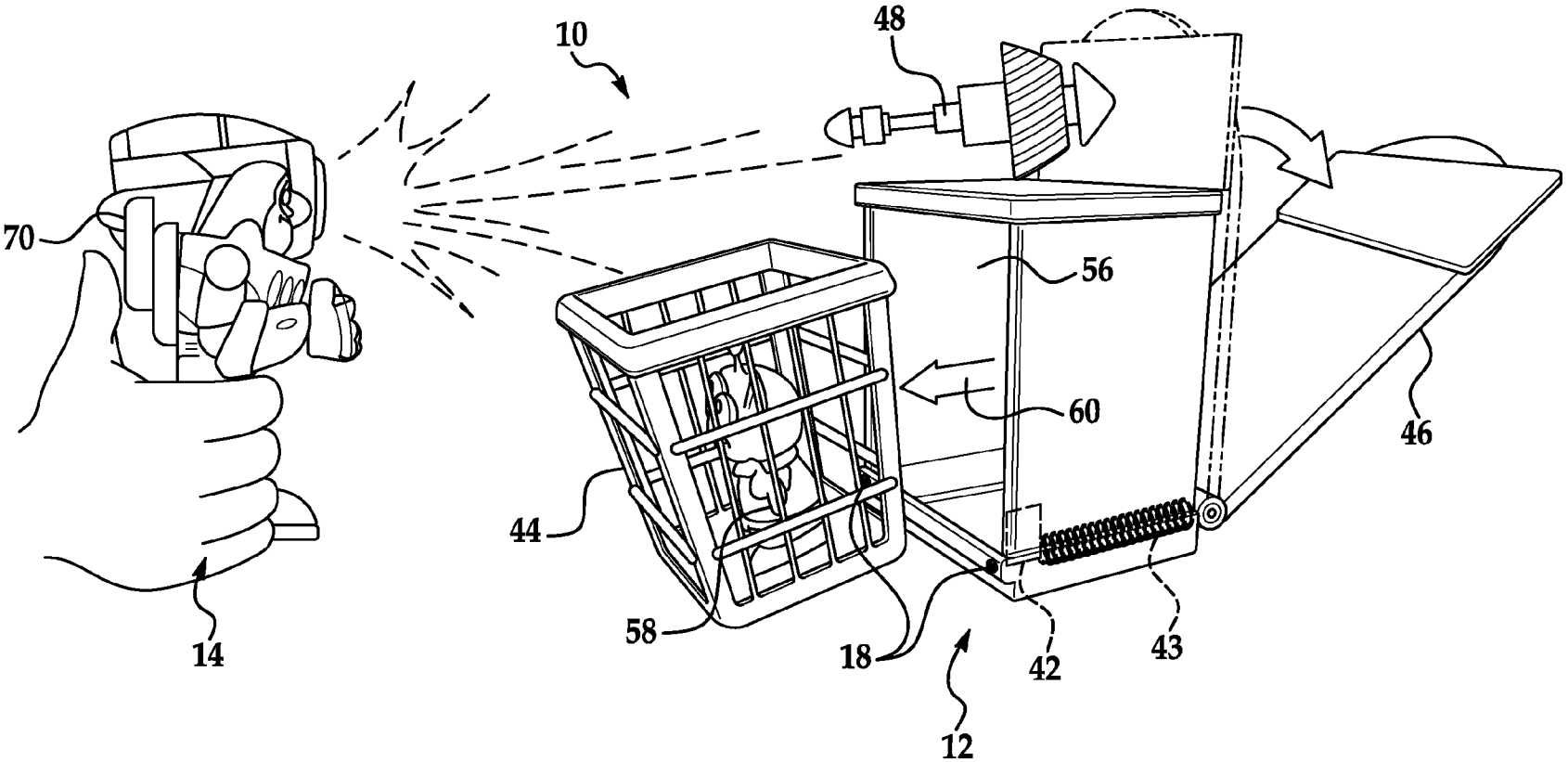
FIG. 3 is another perspective view of the toy set in accordance with an exemplary embodiment of the present invention.

Still further, the first object also includes a spring biased mechanism 42 that is configured to launch an item 44 from the first object. Here the spring biased mechanism 42 is activated to launch the item 44 from the first object when a target 46 is moved from a first position (FIGS. 1, 2 and 5) towards a second position (FIG. 3) and a compressed spring 43 of the spring biased mechanism is released.

In one embodiment, target 46 is moved from the first position to the second position when a projectile 48 is launched from the second object. In this embodiment and when the target is moved to the second position the item is launched from the first object by the spring biased mechanism and the spring biased release mechanism is coupled to the microprocessor such that actuation of the mechanism causes another signal or code to be generated by the LED 18 which signifies completion or the game (e.g., missile hitting target). Here the audio output provided by the second object corresponds with the another signal signifying the end or completion of the game (e.g., the item is launched from the first object).

The second object is also illustrated schematically in FIG. 5. Second object 14 has an IR detector 26 coupled to a microprocessor or other equivalent device 50 that is also coupled to a speaker 52 and a LED 54. In one exemplary embodiment, the microprocessor will read the data from the plurality of signals detected from the first object and play a pre-determined audio output corresponding to the weakest of the plurality of signals received. In addition, the microprocessor will also illuminate the led 54 in a blinking manner the frequency of which corresponds to the weakest of the IR signals received. In one embodiment, the blinking of the led will become faster or more frequently when the second object is closer or detects weaker IR fields. In other words, the LED 54 will be blinking faster when field 20 is detected as opposed to fields 22 and 24.

As illustrated and in one embodiment, the item 44 is a basket that is configured to be received in an opening 56 of the first object and the basket is configured to receive a hidden object or character 58 that is placed in the basket 44.

In one implementation, the play pattern consists of a child or user activating and "hiding" the IR transmitting first object with the character 58 wherein placement of the character 58 in the basket and the basket into the opening 56 of the first object causes the spring biased mechanism 42 to be moved in a direction opposite to arrow 60 such that spring 43 is compressed and engaged by the mechanism 42. During operation or play mechanism 42 is subsequently released by movement of the target 46 from the first position to the second position. Accordingly, the spring biased mechanism is configured to launch the basket and character from the first object when the target is moved from the first position to the second position.

After the first object with the character is hidden and placed on a surface 38 such that switch 34 is depressed and the signals 16 are generated by the IR transmitters of the first object at different power levels. Afterwards, a user can use the second object as an item locator to determine the proximity to the first object to the second object. As the child or user moves, the second object towards the first object the second object will provide feedback (e.g., Cold, Warm, Hot).

As discussed above, the second object includes an IR sensor 26, with approximately a 40-50 degree field-of-view wherein the sensor detects the presence of the codes, and bases its proximity feedback to the user on the faintest code in a set that it can hear or detect. The second object may optionally report that it is too far away to detect any response (e.g., no codes detected). It being understood that the fields of view may be greater or less than the aforementioned values.

As the user moves the second object closer to the first object, the signals are detected and corresponding outputs are provided by the second object. As the second object moves closer it will provide corresponding outputs until it is close enough to launch the projectile 48 at the target 46 and when hit, the hidden or "imprisoned," character is released (by actuating or opening a switch 42, etc.). In addition, the first object may transmit a unique code to the second object which indicates that the character has been "freed" and the first object will play a corresponding output. The audible outputs may be phrases and/or audible beeps that become faster as the second object is closer to the first object.

Figure 6:
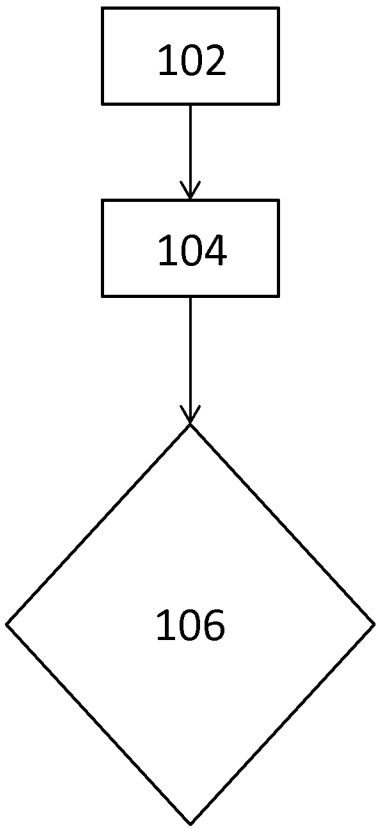
FIG. 6 is a flow chart illustrating a method of providing audio feedback corresponding to the proximity of a first object to a second object of the toy set.

Referring now to FIG. 6 a flow chart 100 illustrating a method of providing audio feedback corresponding to the proximity of the first object 12 to the second object 14 of the toy set 10 is provided. At step 102 a plurality of codes are transmitted wirelessly from the first object 12, wherein each of the plurality of codes are transmitted at a different predetermined power level, and wherein each of the plurality of codes is indicative of the power level of the code being transmitted.

At step 104 the second object detects the sluralit of codes bein transmitted by the first object.

At step 106, the second object selects one of a plurality of audio outputs when one of the plurality of codes is detected by the second object, wherein the one of the plurality of audio outputs is selected by determining which of the plurality of codes detected by the second object has the weakest predetermined power level.

In accordance with various embodiments of the present invention, the first and second objects may be theme or character related in that each object is or contains a character that is representative of a story line in a book, movie, play, television show or any other form of media. Furthermore the objects may be similar to a corresponding scene for the story line, book, movie, play, etc.

In summation, the toy has two pieces an IR transmitting object and an item locator for locating the IR transmitting object. In one exemplary embodiment, the first object is configured to resemble a trap that transmits signals at 3 different levels and a fourth signal that is transmitted or activated by target being hit by a projectile of the second object.

The second object in one embodiment has on/off switch that includes a two stage button or switch 70 that is pushed halfway down for coupling a power supply 72 to the microprocessor wherein three canned responses are provided in response to three signals generated by the first object and detected by the second object. Based upon the signal detected, and when the switch 70 is pushed all the way down to the second stage will cause a launcher to launch the projectile 48 from the second object. Thereafter, the fourth response is provided by the second object in response to a fourth signal generated by the first object when the target of the first object is moved from the first position to the second position.

In one implementation, the response associated with the fourth signal will not be played unless the two stage button is completely depressed to cause the release of the projectile. Accordingly and in one non-limiting embodiment, the response associated with the fourth signal will not be played unless 1) the release mechanism of the first object is actuated and 2) the two stage button has been completely depressed to launch the projectile. This will prevent inadvertent playing of the response associated with the fourth signal unless the captured/hidden character has been freed (e.g., activation of release mechanism). When the target is moved to the second position, the compressed spring force of spring 43 is released and the release mechanism 42 forces the item 44 from the first object in the direction of arrow 60.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A toy set, comprising:

a first toy object configured to transmit a plurality of codes wirelessly, each of the plurality of codes being transmitted at a different predetermined power level;

a second toy object configured to detect the plurality of codes, the second toy object providing one of a plurality of audio outputs when at least one of the plurality of codes is detected by the second toy object; and wherein the one of the plurality of audio outputs is selected by the second toy object by determining which one of the plurality of codes detected by the second toy object has a weakest predetermined power level, wherein the first toy object further comprises a release mechanism for launching an item from the first toy object when a target on the first toy object is moved from a first position to a second position and wherein the target is capable of being moved from the first position to the second position by a projectile launched by the second toy object.

2. The toy set as in claim 1, wherein the first toy object further comprises a pair of wide angle infrared (IR) leds for generating each of the plurality of codes.

3. The toy set as in claim 1, wherein each one of the plurality of audio outputs corresponds to a respective one of the plurality of codes and wherein the plurality of audio outputs is a series of audible beeps.

4. The toy set as in claim 1, wherein the first toy object has a switch that is closed when the first toy object is placed on a surface and the switch, when closed, causes the plurality of codes to be generated.

5. The toy set as in claim 1, wherein each of the plurality of codes is generated sequentially as a series of codes and the series of codes is repeated.

6. The toy set as in claim 1, wherein the first toy object provides one of the plurality of codes when the target is moved from the first position to the second position by the projectile launched by the second toy object.

7. The toy set as in claim 1, wherein the first toy object cannot receive any transmitted signals external to the first toy object and the second toy object cannot transmit any signals from the second toy object.

8. The toy set as in claim 1, wherein each of the plurality of codes has a unique code associated therewith, wherein each unique code of the plurality of codes is indicative of the signal strength of each unique code of the plurality of codes with respect to all of the plurality of codes being transmitted.

9. The toy set as in claim 1, wherein the first toy object provides one of the plurality of codes when the target on the first toy object is moved from a first position to a second position.

10. A toy set, comprising:

a first toy object configured to transmit a plurality of signals wirelessly in a predetermined repeating sequence, each of the plurality of signals having a unique code associated therewith indicating a strength of each of the plurality of signals being transmitted, wherein each of the plurality of signals are transmitted at a different predetermined signal strength such that they are only detectable at predetermined distances from the first toy object;

a second toy object configured to detect the plurality of signals, the second toy object providing one of a plurality of audio outputs when at least one of the plurality of signals is detected by the second toy object; and wherein the one of the plurality of audio outputs is selected by the second toy object by determining which one of the detected plurality of signals is generated at a weakest predetermined signal strength through analysis of the unique codes detected by the second toy object, and wherein the first toy object cannot receive any transmitted signals external to the first toy object and the second toy object cannot transmit any signals from the second toy object.

11. The toy set as in claim 10, wherein the first toy object further comprises a pair of infrared (IR) leds for generating each of the plurality of signals and wherein the first toy object further comprises a release mechanism for launching an item from the first toy object when a target of the first toy object is moved from a first position to a second position and wherein the target is capable of being moved from the first position to the second position by a projectile launched by the second toy object and wherein the first toy object provides one of the plurality of signals when the target is moved from the first position to the second position by the projectile launched by the second toy object.

12. The toy set as in claim 11, wherein each one of the plurality of audio outputs corresponds to a respective one of the plurality of signals;

wherein the plurality of audio outputs are prerecorded messages;

wherein the second toy object further comprises a two stage switch which when pushed to a first stage couples a power supply to a microprocessor of the second toy object and when the two stage switch is pushed to a second stage, a launcher of the second toy object launches the projectile from the second toy object; and wherein one of the plurality of audio outputs corresponding to the one of the plurality of signals provided by movement of the target from the first position to the second position will not be played by the second toy object unless the two stage switch is in the second stage.

13. A method of providing audio feedback corresponding to the proximity of a first toy object and a second toy object of a toy set, comprising:

transmitting a plurality of codes wirelessly from the first toy object, each of the plurality of codes being transmitted at a different predetermined power level, wherein each of the codes is indicative of the power level of the code being transmitted;

detecting the plurality of codes by the second toy object;

selecting one of a plurality of audio outputs from the second toy object when one of the plurality of codes is detected by the second toy object; and wherein the one of the plurality of audio outputs is selected by the second toy object by determining which one of the plurality of codes detected by the second toy object has the weakest predetermined power level, and wherein the first toy object further comprises a release mechanism for launching an item from the first toy object when a target on the first toy object is moved from a first position to a second position, wherein the target is moved from the first position to the second position by a projectile launched by the second toy object.

14. The method as in claim 13, wherein the first toy object further comprises a pair of infrared (IR) leds for generating each of the plurality of codes.

15. The method as in claim 14, wherein the first toy object generates a unique code when the target is moved from the first position to the second position and wherein the second toy object provides a unique audio output corresponding to the unique code when the unique code is detected by the second toy object.

16. The method as in claim 13, wherein the first toy object has a switch that is closed when the first toy object is placed on a surface and the switch, when closed, causes the plurality of codes to be generated by the first toy object.

17. The method as in claim 13, wherein each of the plurality of codes are transmitted sequentially as a series of codes and the transmission of the series of codes is repeated.

18. The method as in claim 17, wherein the first toy object further comprises a pair of infrared (IR) leds for generating each of the plurality of codes and wherein the first toy object generates a unique code when the target is moved from the first position to the second position and wherein the second toy object provides a unique audio output corresponding to the unique code when the unique code is detected by the second toy object.

19. The method as in claim 13, wherein each of the plurality of codes has a unique code associated therewith, wherein each unique code of the plurality of codes is indicative of the signal strength of each unique code of the plurality of codes with respect to all of the plurality of codes being transmitted.

* * * * *